United States Patent [19]

Losenno

[11] Patent Number: 4,616,666

[45] Date of Patent: Oct. 14, 1986

[54] HAIR TREATMENT SOLUTION COLLECTOR

[76] Inventor: Luigi G. Losenno, 2741 Thomas Ave. South, Minneapolis, Minn. 55416

[21] Appl. No.: 498,358

[22] Filed: May 26, 1983

[51] Int. Cl.[4] ..... A45D 1/00

[52] U.S. Cl. ..... 132/9

[58] Field of Search ..... 132/9, 7; 119/61; D4/38.2, 38.1

[56] References Cited

U.S. PATENT DOCUMENTS

| | | | |
|---|---|---|---|
| D. 208,969 | 10/1967 | Paxton | D4/38.2 |
| D. 248,335 | 6/1978 | Cooke | D4/38.1 |
| D. 264,897 | 6/1982 | Smith | D4/38.2 |
| 2,546,817 | 3/1951 | Brunner | 132/9 |
| 2,794,440 | 6/1957 | Levie | 132/7 |
| 3,452,759 | 7/1969 | Sarinelli | 132/9 |
| 3,611,998 | 10/1971 | Loscalzo | 119/61 |
| 3,678,943 | 7/1972 | Noel | 132/9 |
| 4,085,877 | 4/1978 | Hildebrand | D4/38.2 |

FOREIGN PATENT DOCUMENTS

| | | | |
|---|---|---|---|
| 2549267 | 9/1976 | Fed. Rep. of Germany | 119/61 |

*Primary Examiner*—Gregory E. McNeill

*Attorney, Agent, or Firm*—Peterson, Wicks, Nemer & Kamrath

[57] ABSTRACT

A preferred embodiment of a hair treatment solution collector is shown and described according to the teachings of the present invention as including a treatment receiving volume defined by a solution catching area and first and second side walls. The collector further includes a solution introduction ramp connected to the solution catching area and having a free edge. In its most preferred form, the free edge of the solution introduction ramp includes a taper for reducing the thickness of the ramp at the free edge for allowing ease of insertion of the ramp beneath hair curlers, perm rods, and the like. In the preferred embodiment, the collector further includes a handle attached to the back edge of the hair catching area including a generally horizontal portion and a second portion attached thereto at a slight downward angle. Therefore, a finger of the operator can be located under the along the handle with the thumb of the operator being pressed against the top surface of the handle. In its most preferred form, the collector further includes a stand for supporting the collector in a horizontal position to prevent escape or spilling of the hair treatment solution from the receiving volume. Furthermore, in its most preferred form, the side walls extend along the solution introduction ramp to form a solution entrapment portion along the introduction ramp for preventing the hair treatment solution from flowing over the side edges of the ramp.

4 Claims, 2 Drawing Figures

HAIR TREATMENT SOLUTION COLLECTOR

BACKGROUND

The present invention relates generally to collectors and receptacles and relates more particularly to a hair treatment solution collector.

With the increasing interest in the application of hair treatment solution to hair, such as permanent solutions, an increasing need has arisen for collectors for collecting the excess treatment solution during its application to the hair. Specifically, prior to the present invention, cotton was held under curlers or permanent type rods such that any excess treatment solution was absorbed by the cotton. Any further excess solution not absorbed by the cotton or when cotton was not utilized, would then run down the head of the patron onto a towel located around the neck and shoulders of the patron. Thus, in addition to not allowing the reuse of any excess hair treatment solution, this procedure resulted in the excessive use of cottons and towels increasing the overhead costs of the hair treatment.

SUMMARY

The present invention solves these and other problems by providing a hair treatment solution collector for receiving excess hair treatment solution flowing from hair curler type devices. Specifically, the collector of the present invention includes a solution catching area and first and second side walls attached to the side edges of the solution catching area for defining a hair treatment solution receiving and storage volume. The collector further includes a solution introduction ramp for positioning under hair curler type devices for receipt of excess hair solution therefrom and allowing its entry into the hair treatment solution receiving and storage volume. The collector further includes in the preferred embodiment a handle member attached to the back free edge of the solution catching area. Further provided is a member for supporting the collector to prevent escape or spilling of the solution from the hair treatment solution receiving and storage volume.

It is thus a primary object of the present invention to provide a novel hair treatment solution collector.

It is further an object of the present invention to provide such novel hair treatment solution collector which is small in size and easy to utilize.

It is further an object of the present invention to provide such novel hair treatment solution collector which is of a one piece, integral design.

It is further an object of the present invention to provide such novel hair treatment solution collector which is simple in design, easy to manufacture, and which maximizes the materials used.

It is further an object of the present invention to provide such novel hair treatment solution collector which allows support of the collector on a horizontal support surface.

It is further an object of the present invention to provide such novel hair treatment solution collector for placement under hair curler type devices for receipt of excess hair treatment solution therefrom.

It is further an object of the present invention to provide such novel hair treatment solution collector for collecting excess hair treatment applied to the hair for reuse thereof.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
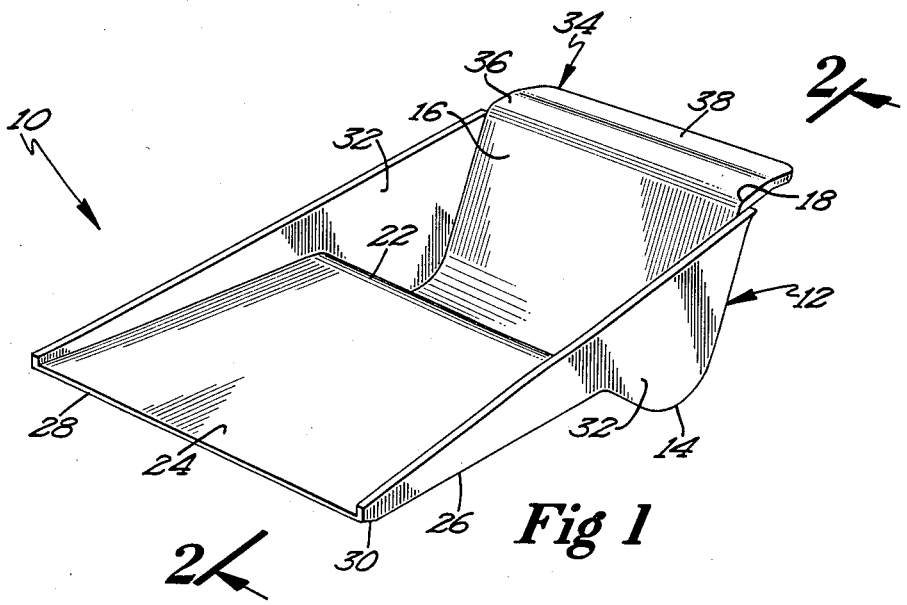
FIG. 1 shows a perspective view of a hair treatment solution collector according to the teachings of the present invention.
Figure 2:
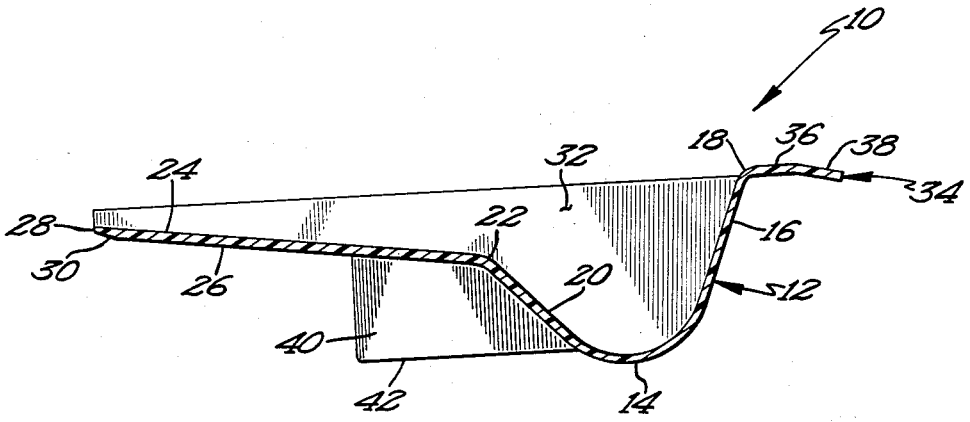
FIG. 2 shows a cross sectional view of the collector of FIG. 1 according to section line 2—2 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, size, and similar requirements will likewise be within the skill of the art after the following teachings of the present invention have been read and understood.

Where used in the various figures of the drawings, the same numerals designate the same or similar parts. Furthermore, when the terms, "top", "bottom", "first", "second", "inside", "outside", and similar terms are used herein, it should be understood that these terms have reference only to the structure shown in the drawings as it would appear to a person viewing the drawings and are utilized only to facilitate describing the invention.

DESCRIPTION

A hair treatment solution collector is shown in the drawings according to the teachings of the present invention and is generally designated 10. Collector 10 in the preferred embodiment of the present invention includes a solution catching area 12 shown in its most preferred form as a channel shaped member 14 having a width and having a generally arch shape of less than 180 degrees. Member 14 further includes a back wall 16 having a width equal to member 14 and which extends generally tangentially and integrally from member 14 and in its most preferred form at an angle of approximatley 40 degrees from the vertical. Back wall 16 has a free edge 18. Member 14 further includes a front wall 20 having a width equal to member 14 and which extends generally tangentially and integrally from member 16 and in its most preferred form at an angle of approximately 50 degrees from the vertical. Front wall 20 has a free edge 22 which is generally parallel to edge 18 but spaced generally vertically below edge 18.

Collector 10 in the preferred embodiment of the present invention further includes a solution introduction ramp 24 attached to free edge 22 of wall 20 at an obtuse angle shown in its preferred form as being approximately equal to 140 degrees. Thus, ramp 24 is at a slight angle to the horizontal and in its most preferred form is approximately 10 degrees below the horizontal. In its most preferred form, ramp 24 is rectangular in shape, has a width equal to front wall 20 which in its most preferred form is slightly larger than the length of the hair curler or perm rod, and the bottom surface 26 adjacent the free edge 28 of ramp 24 includes a taper 30 to reduce the thickness of ramp 24 at edge 28.

Collector 10 in the preferred embodiment of the present invention further includes first and second side walls 32 attached to the side edges of back wall 16, member 14, front wall 20, and ramp 24. In its most preferred form, side walls 32 extend from free edge 18 of wall 16 to a point vertically spaced above edge 28 of ramp 24. Thus, side walls 32 provide a treatment solution entrapment portion adjacent to edge 28 of ramp 24 and throughout the length of ramp 24 to prevent solution from flowing over the side edges of ramp 24.

Collector 10 in the preferred embodiment of the present invention further includes handle 34. Handle 34 has a width generally equal to back wall 16 and generally includes a generally horizontal portion 36 attached to edge 18 of wall 16 and a second portion 38 attached to portion 36 at a slight downward angle.

Collector 10 in the preferred embodiment of the present invention further includes a stand 40 attached to front wall 20 and bottom surface 26 of ramp 24. Stand 40 includes a support surface 42 which is generally horizontal.

Now that the structure of the present invention has been explained, the operation and subtle features and advantages of the present invention can be set forth and appreciated. First, the shape, width and construction of handle 34 allows the forefinger of the operator to be placed along and under first and second portions 36 and 38. The thumb of the operator can then be placed on the top surface of handle 34 for capturing handle 34 between the forefinger and the thumb. It can then be appreciated that handle 34 is of an advantageous shape, size, and construction for allowing ease of handling and operation of collector 10 over other handle shapes, forms, and constructions.

In operation, when hair treatment solution is to be applied to hair curlers, rods, or like structure, collector 10 is placed such that ramp 24 is located beneath the curler or rod located in the hair with free edge 28 of ramp 24 abutting with the hair of the patron. It can be appreciated that taper 30 of ramp 24 allows collector 10 to be easily fitted and inserted under the curlers or rods of the hair, especially adjacent to and for insertion into the vortex between the hair extending from the head of the patron into the curler when the hair is tightly wrapped around the curler. Thus, any excess hair treatment solution placed upon the curler will run from the curler and onto ramp 24 and will flow thereon into solution catching area 12. It should then be noted that due to the close proximity of taper 30 of free edge 28 into and beneath the hair curler insures the maximum collection of any excess hair treatment solution from the hair. Furthermore, due to the preferred construction, form, and size of side walls 32, the side walls provide a treatment solution entrapment portion preventing solution from flowing over the side edges of ramp 24.

Further, due to the preferred construction of side walls 32, any hair treatment solution collected and stored in the solution catching area 12 can be easily poured therefrom into a bottle by tilting collector 10 such that the hair treatment solution can be poured from area 12 by flowing in one of the corners located between ramp 24 and side walls 32.

Between applications of treatment solution to the curlers, collector 10 in its most preferred form can be simply placed on a horizontal flat surface such that the bottom portion of solution catching area 12 and support surface 42 of stand 40 is located upon and rests on the horizontal support surface.

Due to the preferred shape, form, and construction of stand 40, free edge 28 of ramp 24 is held in a vertically spaced position above the support surface for preventing any collected hair treatment solution located in the hair treatment solution receiving and storage volume from running down ramp 24 onto the support surface. Furthermore, handle 34 is also held in a vertically spaced position above the support surface for allowing easy grasp by the hand of the operator. Thus, collector 10 can rapidly be placed upon a support surface and picked up therefrom without major concern of the escape or spilling of the hair treatment from the receiving and storage volume.

It should then also be appreciated that the preferred form, construction, and shape of the components of collector 10 and specifically catching area 12, ramp 24, side walls 32, handle 34, and stand 40 allow the advantageous manufacture of collector 10 as a unitary, integral structure of a small size and weight which can be easily manufactured and sold.

Now that the basic teachings of the present invention have been explained, many extensions and variations will be obvious to one having ordinary skill in the art. For example, stand 40 is of a preferred form for supporting collector 10 upon a generally horizontal support surface. After the teachings of the present invention become known, other support members may be obvious in view thereof.

Additionally, the shape, size, form, and construction of the handle is believed to be particularly advantageous to the overall construction of collector 10 according to the teachings of the present invention. However, if these advantages are not desired, the handle can be of different types according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Hair treatment solution collector comprising, in combination: a solution catching area having a first side edge, a second side edge, a front edge, and a back edge; a solution introduction ramp having a first side edge, a second side edge, a first edge, and a second, free edge, with the first edge of the solution introduction ramp being connected to the front edge of the solution catching area; a first side wall attached to the first side edge of the solution catching area and the first side edge of the solution introduction ramp; a second side wall attached to the second side edge of the solution catching area and the second side edge of the solution introduction ramp, with the first and second side walls and the solution catching area defining a receiving volume for receiving and storing hair treatment solution, with the second, free edge of the solution introduction ramp being spaced vertically below the back edge of the solution catching area, with the first and second side walls extending generally from the back edge of the solution catching area to a point vertically spaced above the free edge of the solution introducing ramp for forming a treatment solution entrapment portion throughout the length of the solution introduction ramp for preventing solution from flowing over the side edges of the solution introduction ramp, with an obstruction free opening being formed by and defined by the free edge of the solution introduction ramp and the first and second side walls; a handle member attached to the back edge of the solution catching area for grasping by the operator allowing the solution introduction ramp to be placed under a hair curler type device for receipt of hair solution therefrom; and means for supporting the collector on a generally horizontal support surface to prevent escape or spillage of the solution from the receiving volume defined by the solution catching area and the first and second side walls comprising a stand attached to the bottom surface of the solution introduction ramp, with the stand having a first end attached to the front wall of the solution catching area and having a second end spaced from the second, free edge of the solution introduction ramp, and with the stand having a generally horizontal support surface.

2. The hair treatment solution collector of claim 1 wherein the solution catching area comprises, in combination: a channel shaped member having a generally arch shape of less than 180 degrees; a flat back wall extending generally tangentially from the channel shaped member, with the back wall including the back edge; and a flat front wall extending tangentially from the channel member, with the front wall including the front edge.

3. The hair treatment solution collector of claim 2 wherein the back wall extends from the channel shaped member at an angle of approximately 50 degrees from the vertical; and wherein the front wall extends from the channel shaped member at an angle of approximately 40 degrees from the vertical.

4. Hair treatment solution collector comprising, in combination: a solution catching area having a first side edge, a second side edge, a front edge, and a back edge; a solution introduction ramp having a first side edge, a second side edge, a first edge, and a second, free edge, with the first edge of the solution introudction ramp being connected to the front edge of the solution catching area; a first side wall attached to the first side edge of the solution catching area; a second side wall attached to the second side edge of the solution catching area, with the first and second side walls and the solution catching area defining a receiving volume for receiving and storing hair treatment solution; a handle member attached to the back edge of the solution catching area for grasping by the operator allowing the solution introduction ramp to be placed under a hair curler type device for receipt of hair solution therefrom; and means for supporting the collector on a generally horizontal support surface to prevent escape or spillage of the solution from the receiving volume defined by the solution catching area and the first and second side walls comprising a stand attach to the front wall of the solution catching area and bottom surface of the solution introduction ramp and having a generally horizontal support surface; with the handle having an elongated width and comprising, in combination: a generally horizontal portion attached to the back edge of the solution catching area and a second portion attached to the first, horizontal portion at a light downward angle allowing a forefinger to be placed along and under the first and second portions of the handle with the thumb resting upon the top surface of the first and second portions of the handle to thereby capture the handle between the forefinger and the thumb of the operator.

* * * * *